United States Patent [19]

Nakamura

[11] Patent Number: 4,941,837

[45] Date of Patent: Jul. 17, 1990

[54] ELECTRICAL CONNECTOR

[75] Inventor: Masahiko Nakamura, Kitakatsuragi, Japan

[73] Assignee: Hosiden Electronics Co., Ltd., Osaka, Japan

[21] Appl. No.: 364,334

[22] Filed: Jun. 8, 1989

[30] Foreign Application Priority Data

Jun. 17, 1988 [JP] Japan ..... 63-80989[U]

[51] Int. Cl.[5] ..... H01R 13/64

[52] U.S. Cl. ..... 439/341

[58] Field of Search ..... 439/341, 326, 376, 660

[56] References Cited

U.S. PATENT DOCUMENTS

| | | | |
|---|---|---|---|
| 1,835,109 | 12/1931 | Ayres | 439/341 |
| 3,617,985 | 11/1971 | Kehl | 439/341 |
| 3,951,501 | 4/1976 | Bauerle et al. | 439/341 |
| 4,257,665 | 3/1981 | John et al. | 439/341 |
| 4,838,806 | 6/1989 | Igarashi | 439/341 |

FOREIGN PATENT DOCUMENTS

| | | | |
|---|---|---|---|
| 119951 | 9/1984 | European Pat. Off. | 439/341 |
| 3634695 | 4/1988 | Fed. Rep. of Germany | 439/341 |
| 3744277 | 7/1988 | Fed. Rep. of Germany | 439/376 |

*Primary Examiner*—William Briggs

*Attorney, Agent, or Firm*—Armstrong, Nikaido, Marmelstein, Kubovick & Murray

[57] ABSTRACT

A socket and plug coupling assembly wherein the socket is a box-like frame with walls of the top and front partially removed, and has pins arranged on a bottom to extend upwardly. At the base of the pins the remaining front stub wall forms a brace in which a slope is formed to be inclined inwardly downwardly of the socket frame. The plug is shaped to be a box-like frame with openings on a bottom continuing to a front wall and the plug has contact members inside the frame openings facing frontwardly. A nail is provided at a rear end of the plug frame extending downwardly from the bottom. In a coupling action of the plug with the socket, first, the nail of the plug is obliquely contacted on the slope of the socket via a face to face approach of the plug toward the socket and then, rotating inwardly about the contact of the nail with the slope, the plug is turned to couple with the socket.

2 Claims, 4 Drawing Sheets

A
B
10
11
12
20
21
22
30
111
111a
112
113
115
121
211
212
213
215
221
222
223

ELECTRICAL CONNECTOR

FIELD OF THE INVENTION

This invention relates to an electrical connector. Particularly, this relates to an electrical connector suitably applied to an electronic apparatus.

DESCRIPTION OF THE CONVENTIONAL ART

In this section, for convenience of describing the related conventional art in contrast to the present invention, the description will proceed with reference to FIGS. 4 and 5 attached, wherein exemplified is a four (4) pin connector for connecting to an electrical source.

In the drawings. 10 is a socket which is secured on a substrate (not shown, located in a case 40) incorporated in an electronic apparatus and 20 is a plug which is coupled removably with the socket 10 at a connection window 41 provided on the cae 40. There are two types of the connections: lateral and vertical. FIG. 4 shows a lateral or straight out type and FIG. 5 shows a vertical or flexed type.

In the former lateral type, the plug 20 occupies some excess desk space in addition to the space for the case 41, which disadvantage is saved by the latter vertical type, but in this type, manual operation of aligning the plug to the socket is not easy.

SUMMARY OF THE INVENTION

This invention achieved easiness in aligning and also dispensing with an excess space, in comparison with disadvantages with the conventional art socket-plug coupling assemblies.

A socket and plug coupling assembly of the present invention is summarized as below:

The socket is shaped to be a box-like frame with walls of the top and front partially removed, and the socket has pins arranged on a bottom extending upwardly and, at the base of the pins and integrally to the remaining front stub wall, a slope is formed to be inclined inwardly downwardly of the socket frame. The plug is shaped to be a box-like frame with openings on a bottom continuing to a front wall, and the plug contains plug contact members inside the frame openings to face the front, and a nail is provided extending at a rear end on the bottom downwardly from the plug frame. In a coupling action of the plug with the socket, first, the nail of the plug is contacted on the slope of the socket moved obliquely via a face to face approach of the plug toward the socket and then, rotating inwardly about the contact of the nail with the slope, the plug is turned to couple the socket with the plug.

BRIEF DESCRIPTION OF THE DRAWINGS

FIGS. 4 and 5 show perspective views to generally explain how a connector of plug-socket assembly is mounted on an electrical device according to the conventional art.

Figure 1B:
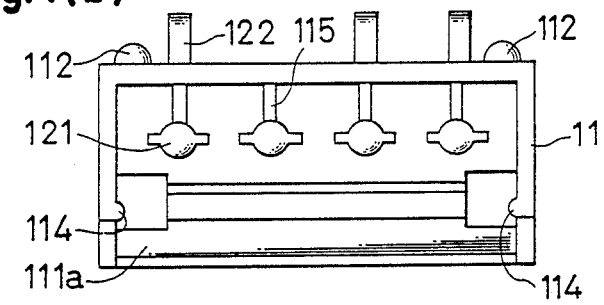
FIG. 1 shows an embodiment of a socket which takes part in an inventive connector assembly, wherein a drawing FIG. 1(*a*) shows a front elevation view, partly broken, FIG. 1(*b*) shows a plan view, FIG. 1(*c*) shows a bottom view, and FIG. 1(*d*) shows a sectional side view along the A—A line indicated in FIG. 1(*a*).
Figure 1D:
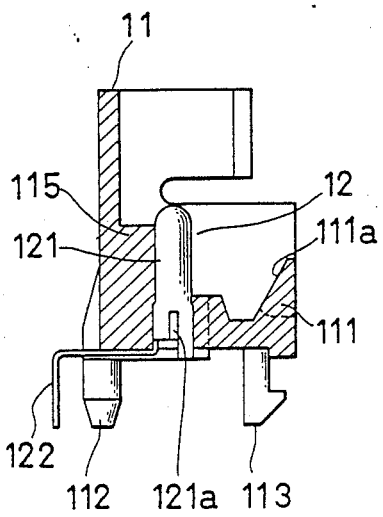
Figure 1A:
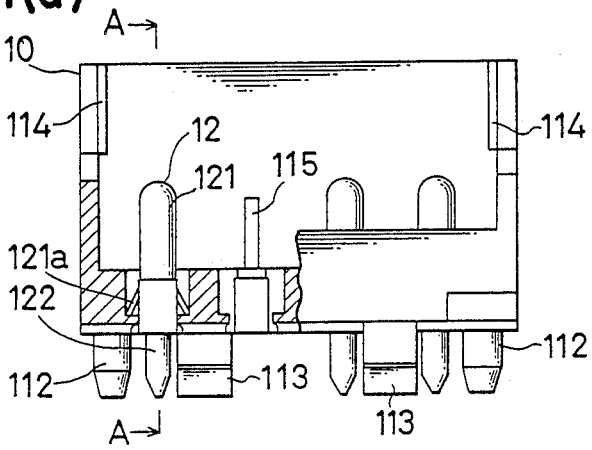
Figure 1C:
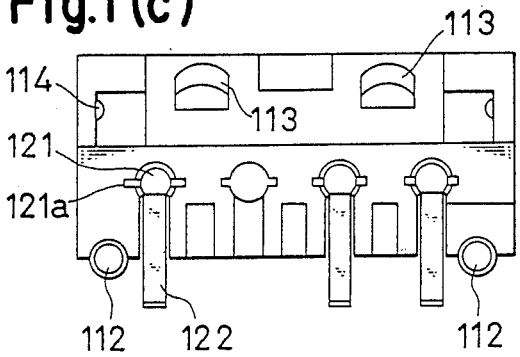
Figure 2B:
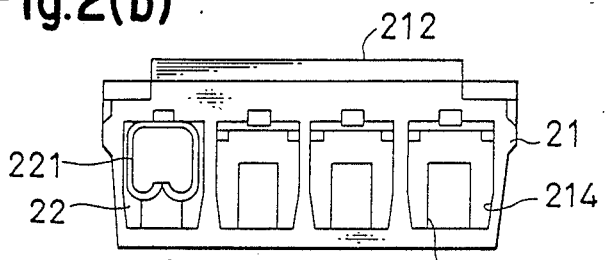
FIG. 2 shows an embodiment of a plug which takes mating part in the inventive connector assembly, wherein a drawing FIG. 2(*a*) shows a front elevation view, partly broken, FIG. 2(*b*) shows a plan view, FIG. 2(*c*) shows a bottom view, FIG. 2(*d*) shows a side view, and FIG. 2(*e*) shows a sectional view along the B—B line indicated in FIG. 2(*a*).
Figure 2E:
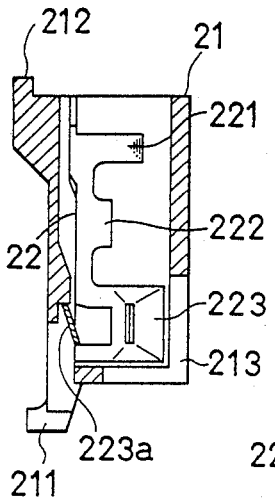
Figure 2A:
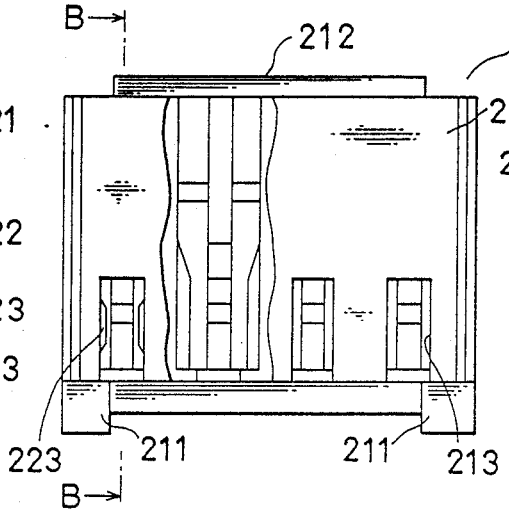
Figure 2D:
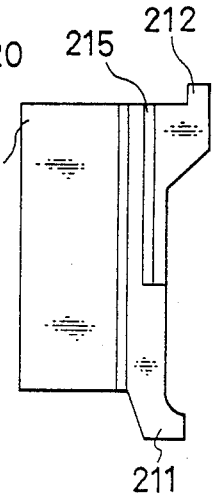
Figure 2C:
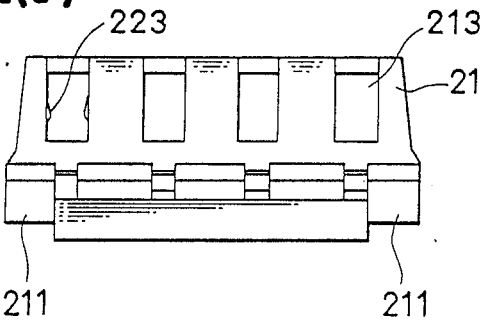

These drawings are presented to illustrate the invention and therefore these presentations should not be construed as limiting the invention.

DESCRIPTION OF THE EMBODIMENTS

With reference to FIGS. 1, 2, and 3, 10 is a socket which is normally mounted, prior to the assembly, on a printed substrate 30 which is often incorporated in an electrical apparatus, wherein a plug 20 is approached to the socket 10 obliquely from some superjacent position and will be coupled in a state almost merged with the socket or in a state accommodated in the socket.

Referring to the socket 10, this coupling half has a generally box-shaped frame or body 11 with two walls at the front and top partially removed and a plurality of pins 12, made of metal, (four pins are shown in the drawings) which are secured extending upwardly on the bottom. Said socket body 11 is normally molded from an insulative plastic material, wherein at two side corners which are located at two opposed lateral sides of a row of the pins 12, braces 111 each forming a slope 111*a* are formed (best seen in FIG. 1(*d*)). The slope 111*a* is utilized, as a will be apparent, as guide member to contact first obliquely with a hook-like nail 211 provided on the plug 20 and wherein, at a subjacent bottom face under the brace 111, the bottom face is designed so that the nail 211 will clamp thereon. On the same bottom face bosses 112 are formed in order to ease a positioning of each socket in mounting thereof onto the printed substrate 30, and also formed are a few hooks 113 to clamp the printed substrate 30 for securing the mounting thereof (see also FIG. 3). Further, inside of the socket wall 11 a few male flutes 114 are integrally provided which will engage with female flutes 215 provided in the plug 20 as will be apparent later, and also a few sub-screen like walls 115 (four of with are seen) are integrally extended so as to abut respectively against the pin 12, whereby a pins 12 will be supported or protected from swaying due to a push which will take place at the time of coupling, as will be apparent later.

Each pin 12 comprises a pin body 121 which is press-mounted on the socket 10, and a lead 122 which is extended from the pin body 121 to outside of the socket 11 taking generally an L-shaped pattern, wherein a pair of pin stays 121*a* are provided to support each pin 121 at its footing level (best seen in FIG. 1(*a*)).

Making reference to the plug 20 which will be removably coupled with the socket 10, it comprises a plug body 21 which is normally molded from an insulative plastic and a corresponding number of socket members 22, made of metal, which are arranged in the body 21. Generally the body 21 is shaped to be a box-like frame or body having the size comparable to the socket and is provided with a few openings 214 (four of which are seen) on top and in correspondence to other openings 213 on the bottom each continuing to front, wherein the opening 214 is for feeding through a lead, not shown, and the opening 213 is for feeding through a pin 12 of the socket 10 in a coupling action. A pair of nails 211 are extended at opposed corners rearwardly of the bottom of the body 21 and a hand block 212 is formed on the top of the body. Further, at two side walls of the body 21, a few female flutes 215 are provided to engage the flutes 114 of the socket 10.

Then, the socket member 22 integrally comprises a holder portion 221 to embrace the lead mentioned, specifically, a covered lead line, and a contact portion to connect with a core line of the lead, and a pincer portion 223 to hold a pin 12 by two side pincers, wherein each pincer portion 223 has, at its rear end, a flap 223*a* which is mounted to the plug body 21 to fix a socket member 22, and further it is devised that through an opening 213, a pincer portion 223 can be seen from outside.

Figures 3A, 3B, 3C:
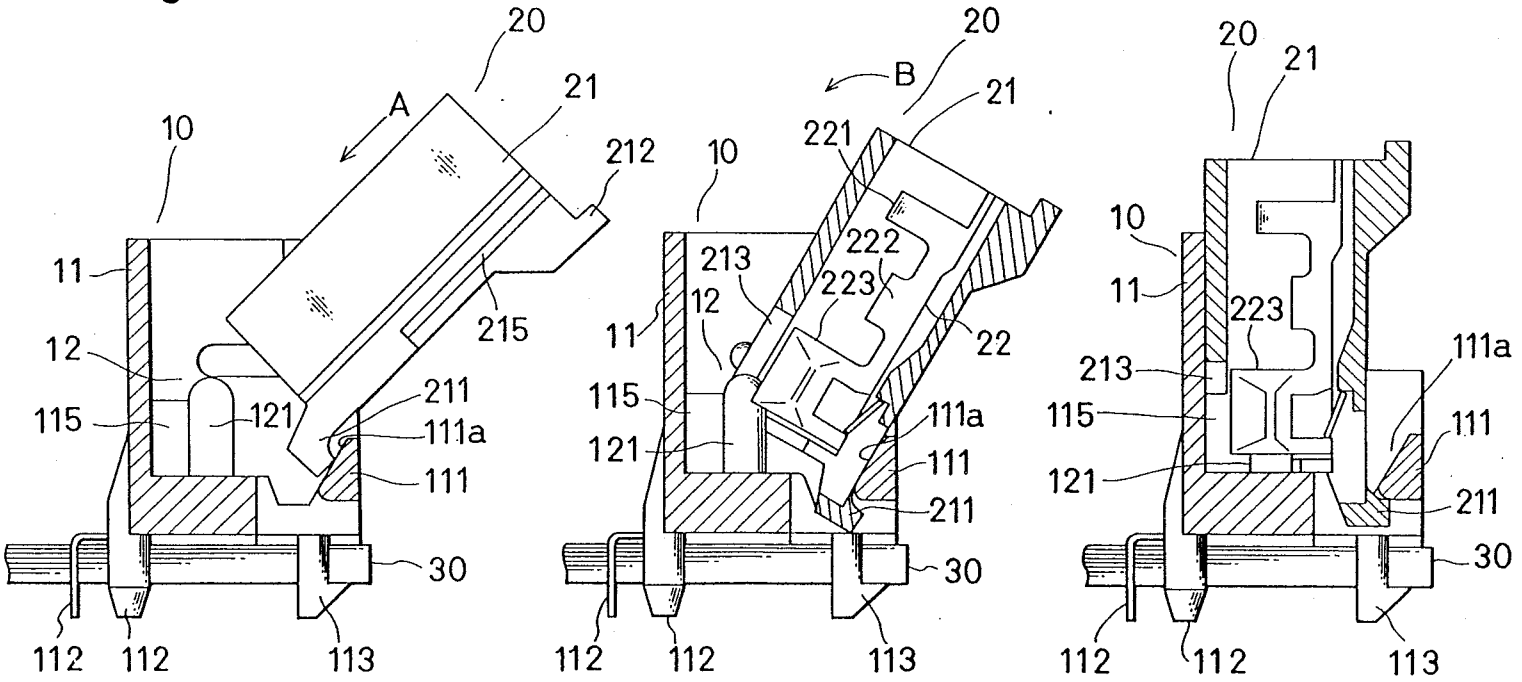
FIG. 3, comprising three drawings FIG. 3(*a*) to FIG. 3(*c*), shows sequential states in the act of coupling the plug with the socket.

Making reference to a coupling action according to FIG. 3, first, it is presupposed that a socket 10 is already mounted with help of the boss 112 and the hooks 113 at a prescribed place on a printed substrate 30. Then, as shown in FIG. 3(*a*), by a front-to-front approach of the two mating halves, the tip of the nail 211 of the plug 20 is obliquely contacted onto the slope 111*a* and the plug 20 is pushed in the direction of arrow line A indicated in the same drawing toward the socket, wherein the plug is slid down obliquely into the socket 10. Accordingly, the nail 211 is turned to engage on the bottom under the brace 111 when the plug 20 is turned inwardly about the contact of the nail 211 with the brace 111 as a fulcrum, in the direction of arrow line B indicated in FIG. 3(*b*). Meanwhile the pins 12 of the socket 10 are passed through the opening 213 of the plug 20, which results that each pin 12 is allowed to contact with the pincer portion 223 of the plug 20. Further the turn of the plug 20 in the direction of the arrow B brings the plug 20 to be held by the two side pincer members of pincer portion 223 in place which automatically engages in place, the nail 211 under the brace 111. Likewise, the female fute 215 engages to the male flute 114 to complete the coupling action of the plug to the socket as seen in FIG. 3(*c*).

What is claimed is:

1. A socket and plug coupling assembly comprising:

a socket member of box-like shape having a bottom, two side walls, a rear wall, and a partial front wall adjacent the bottom forming a brace, said socket member including a plurality of contact pins mounted on the bottom and extending upwardly therewithin, said socket member being formed with an inner surface of said brace having a slope inclined downwardly toward said pins, and having at least one opening formed in the bottom adjacent said brace; and a plug member of a box-like shape and a size fitting to an interior space of said socket member, said plug member having a plurality of openings formed in a bottom and front wall thereof corresponding in position to said contact pins of said socket member, contact means affixed to a rear wall within said plug member adjacent said openings, said plug member rear wall being formed with at least one hook-like nail member extending downwardly and having a distal end portion projecting outwardly, at a position corresponding to said at least one opening in said socket member bottom;

said socket and plug coupling assembly being removably assembled by moving said plug member nail obliquely in contact with said brace inner inclined surface to enter said socket member bottom at least one opening, and then turning the plug inwardly of said socket member such that said socket member contact pins enter said plurality of openings to engage the contact means therewithin, said nail distal end portion thereby engaging a bottom edge of said brace.

2. A socket and plug coupling assembly as recited in claim 1, further comprising flutes formed on outer side walls of said plug member and mating flutes formed on inner side walls of said socket member, such that completion of said turning movement of the plug engages said mating flutes.

* * * * *